US006863788B2

(12) United States Patent
Tabereaux, Jr. et al.

(10) Patent No.: US 6,863,788 B2
(45) Date of Patent: Mar. 8, 2005

(54) INTERLOCKING WETTABLE CERAMIC TILES

(75) Inventors: Alton T. Tabereaux, Jr., Muscle Shoals, AL (US); Guy L. Fredrickson, Golden, CO (US); Eric Groat, Williamsville, NY (US); Thomas Mroz, Kenmore, NY (US); Alan Ulicny, Amherst, NY (US); Mark F. Walker, Richmond, VA (US)

(73) Assignee: Alcoa Inc., Pittsburgh, PA (US)

( * ) Notice: Subject to any disclaimer, the term of this patent is extended or adjusted under 35 U.S.C. 154(b) by 234 days.

(21) Appl. No.: 10/206,472

(22) Filed: Jul. 29, 2002

(65) Prior Publication Data

US 2004/0016639 A1 Jan. 29, 2004

(51) Int. Cl.[7] ..... C25C 7/02
(52) U.S. Cl. ..... 204/243.1; 204/279
(58) Field of Search ..... 204/243.1, 279

(56) References Cited

U.S. PATENT DOCUMENTS

| | | | | |
|---|---|---|---|---|
| 3,400,061 A | | 9/1968 | Lewis et al. | 204/67 |
| 4,073,318 A | | 2/1978 | Close et al. | 138/149 |
| 4,093,524 A | | 6/1978 | Payne | 204/61 |
| 4,231,853 A | * | 11/1980 | Rahn | 204/247.3 |
| 4,243,502 A | | 1/1981 | Kugler | 204/243 R |
| 4,439,382 A | | 3/1984 | Joó et al. | 264/29.5 |
| 4,443,313 A | | 4/1984 | Gesing et al. | 204/240 |
| 4,544,524 A | | 10/1985 | Mizrah et al. | 419/9 |
| 4,592,820 A | | 6/1986 | McGeer | 204/243 R |
| 4,650,552 A | | 3/1987 | de Nora et al. | 204/67 |
| 4,722,280 A | | 2/1988 | Sanai | 102/289 |
| 5,028,301 A | | 7/1991 | Townsend | 204/39 |
| 5,320,717 A | | 6/1994 | Sekhar | 204/67 |
| 5,470,140 A | | 11/1995 | Schagunn | 312/140.3 |
| 5,630,304 A | | 5/1997 | Austin | 52/384 |
| 5,743,059 A | | 4/1998 | Fifield | 52/519 |
| 5,746,895 A | | 5/1998 | Sekhar | 204/279 |
| 5,876,584 A | | 3/1999 | Cortellini | 205/379 |
| 5,938,914 A | | 8/1999 | Dawless et al. | 205/391 |
| 6,103,091 A | | 8/2000 | Sekhar et al. | 205/387 |

FOREIGN PATENT DOCUMENTS

AU 2000-27615 10/2000

* cited by examiner

*Primary Examiner*—Roy King
*Assistant Examiner*—Harry D. Wilkins, III
(74) *Attorney, Agent, or Firm*—Daniel P. Cillo; Julie W. Meder

(57) ABSTRACT

An electrolytic cell for the reduction of aluminum having a layer of interlocking cathode tiles positioned on a cathode block. Each tile includes a main body and a vertical restraining member to prevent movement of the tiles away from the cathode block during operation of the cell. The anode of the electrolytic cell may be positioned about 1 inch from the interlocking cathode tiles.

13 Claims, 2 Drawing Sheets

INTERLOCKING WETTABLE CERAMIC TILES

STATEMENT REGARDING FEDERALLY FUNDED RESEARCH

The subject matter of this application was made with United States Government support under Contract No. DE-FC07-97ID13567 awarded by the Department of Energy. The United States Government has certain rights to this invention.

BACKGROUND OF THE INVENTION

1. Field of the Invention

The present invention relates to cathode assemblies for use in Hall-Heroult aluminum reduction cells, more particularly, to cathode assemblies having a plurality of interlocking wettable ceramic tiles covering the cathode blocks.

2. Prior Art

Aluminum is commonly manufactured by a smelting process in an electrolytic cell of the established Hall-Heroult design. A conventional Hall-Heroult electrolytic cell includes a cell defining a chamber housing carbonaceous anodes. The anodes are suspended in a bath of electrolytic fluid containing alumina and other materials. Electric current is supplied to the anodes to provide a source of electrons for reducing alumina to aluminum that accumulates as a molten aluminum pad. The molten aluminum pad forms a liquid metal cathode. A cathode assembly is positioned in the bottom of the chamber and completes the cathodic portion of the cell. The cathode assembly includes cathode blocks having an upper surface, which supports the molten aluminum pad. Collector bars are received within a lower portion of the cathode blocks and are connected via a bus bar to a current supply in a conventional manner to complete the circuit.

These electrolytic cells are typically operated at high temperatures (about 940 to 980° C.) which, when combined with the corrosive nature of electrolytes creates a harsh environment. Cathode blocks have historically been formed from a mixture of anthrocite and pitch binder and exhibit relatively high electrical resistivity, high sodium swelling, low thermal shock resistance, and high abrasion resistance. As aluminum producers seek to increase productivity, the operating amperages for such cells have been increased. Hence the need for reduced power losses in the smelting process has increased. One limitation in the operation of an electrolytic cell is the distance between the lower surface of the anode and the upper surface of the liquid metal cathode. Conventionally, this distance has been about 4 to about 5 centimeters. It is well-established that substantial savings in the electrical energy required for the operation of the cell could be achieved by reducing the distance between the anode and the cathode. Reduction of the anode to cathode distance in conventional electrolytic reduction cells has been limited by the strong magnetic forces in the horizontal plane as a result of the interaction of horizontal current components in the molten metal with strong magnetic fields existing within the cell. The magnetic forces acting on the molten metal lead to an intermittent shorting between the anodes and the molten metal cathode when the anode to cathode distance is reduced below the conventional 4 to 5 cm.

More recently, it has been recognized that these difficulties may be obviated by covering the cathode block with individual packing elements with a surface which is resistant to attack but yet is wettable by the molten metal, but not wettable by the molten electrolyte thereby using the interfacial tension forces of the molten metal/electrolyte interface to restrain entry of the molten electrolyte into the bed of packing elements. Such a system is disclosed in U.S. Pat. No. 4,443,313, incorporated herein by reference, which discloses a tightly packed monolayer of loose elements formed from materials, such as $TiB_2$, in various geometric shapes. A significant drawback to the system disclosed therein is the moveability of the packing elements, particularly in the vertical direction.

Accordingly, a need remains for an electrolytic cell which may be operated with a reduced anode/cathode distance by including a surface on the cathode block which is wettable by the molten metal yet is not subject to shifting during operation of the cell.

SUMMARY OF THE INVENTION

This need is met by the interlocking cathode tiles of the present invention. The interlocking cathode tiles of the present invention are positioned on the cathode block and include vertical restraining members. The vertical restraining member includes an upper tab extending from a body of one tile and a lower tab extending from a body of another tile such that the lower tab is restrained from vertical movement by the upper tab of an adjoining tile. Each tile may comprise an upper tab and a lower tab on different locations of the tile. The tile may be polygonal, such as hexagonal, with upper tabs extending from a plurality of sides of the main body and lower tiles extending from other sides of the main body. The tile may be manufactured from a ceramic material, such as $TiB_2$—C, which may contain about 95 wt. % $TiB_2$ and about 5 wt. % C.

In use in an electrolytic cell, the main bodies are spaced apart by about 1/16 to about =b 3/16 inch. This system allows for the cathode block to be spaced about 1 inch from the anode. The upper surface of the interlocking tiles may be horizontal or up to about 5° from horizontal.

The electrolytic cell may further define a sump for receiving molten aluminum. The sump is positioned adjacent to an edge of the surface of interlocking tiles. A plurality of retaining tiles may be positioned between the edge of the layer of interlocking tiles and the sump to retain the interlocking tiles in position. The retaining tiles each may be a planar tile positioned substantially vertically with one end fixed within the cathode block. Alternatively, the retaining tiles may be L-shaped with a pair of legs, one leg fixed into the cathode block with the other leg extending towards the sump.

DETAILED DESCRIPTION OF THE DRAWINGS

A complete understanding of the invention will be obtained from the following description when taken in connection with the accompanying drawing figures wherein like reference characters identify like parts throughout.

FIG. 1 diagrammatically illustrates the use of a layer interlocking tiles and a restraining tile of the present invention in a conventional electrolytic reduction cell;

DETAILED DESCRIPTION OF THE PREFERRED EMBODIMENTS

Figure 1:
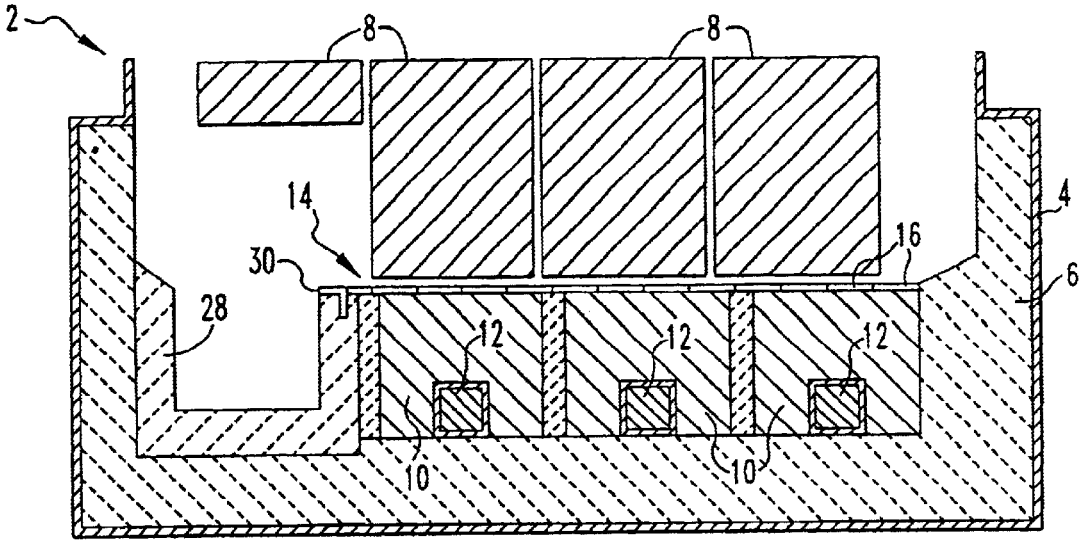

For purposes of the description hereinafter, the terms "upper", "lower", "right", "left", "vertical", "horizontal", "top", "bottom" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Figure 2:
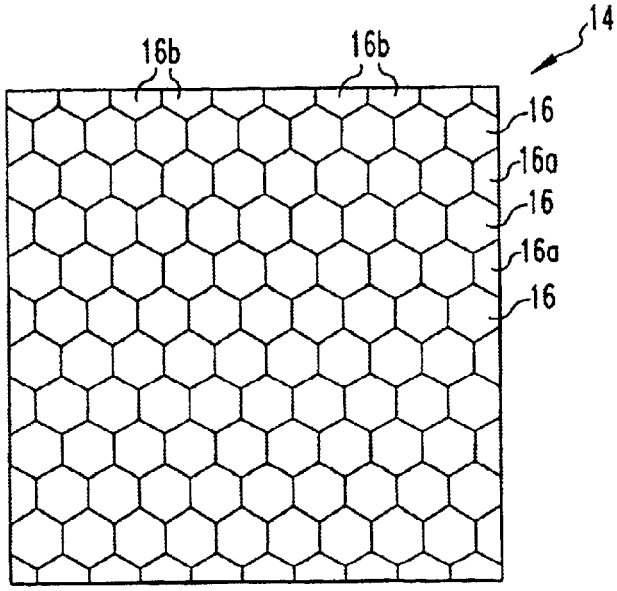
FIG. 2 is a plan view of the layer of interlocking tiles shown in FIG. 1.
Figure 3:
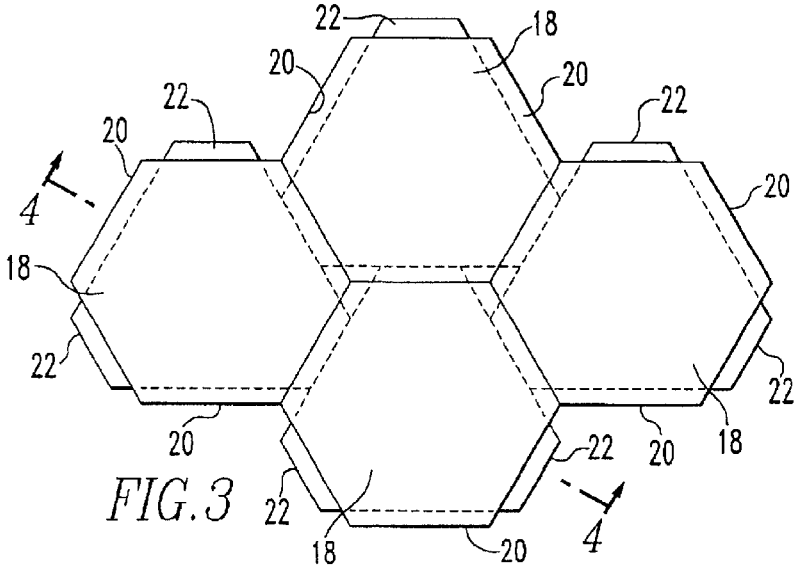
FIG. 3 is a plan view of four interlocking tiles shown in FIG. 2.

FIG. 1 shows an electrolytic reduction cell 2 constructed in part in an essentially conventional manner having a shell 4 surrounding insulating material 6 and housing a plurality of anodes 8 suspended above a plurality of cathode blocks 10 receiving collector bars 12. However, the cell 2 of the present invention includes a layer 14 of the interlocking tiles 16 covering the cathode blocks 10. The lower surface of the anodes 8 are spaced a minimum distance away from the surface of the layer 14 of interlocking tiles 16, such as about 1 inch. The interlocking tiles 16 may be polygonal in configuration and are shown in FIG. 2 as being hexagonal. The edges of the layer 14 of interlocking tiles 16 may include tiles 16*a* that have been cut in half alternating between uncut tiles 16 or a row of tiles 16*b* cut in half.

Figure 4:
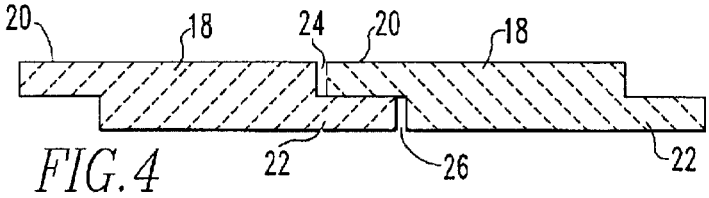
FIG. 4 is a sectional view of a pair of tiles shown in FIG. 3 taken along line 4—4.
Figure 5:
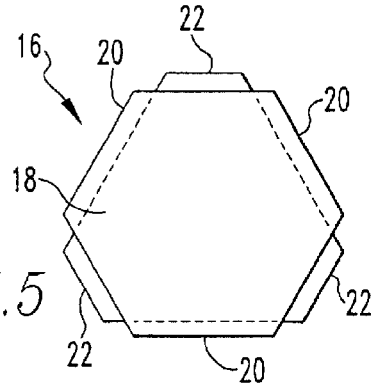
FIG. 5 is a top view of one of the interlocking tile of the present invention.
Figure 6:
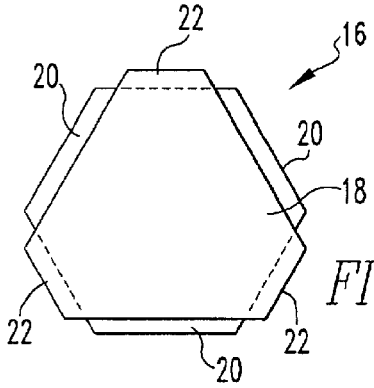
FIG. 6 is a view of the underside of the tile shown in FIG. 5.

FIGS. 3-6 show the interlocking tiles 16 in more detail. Each tile 16 includes a main body 18 that is restrained from vertical movement by a vertical restraining member. The vertical restraining member includes an upper tab 20 extending from the main body 18 of one tile 16 and a lower tab 22 extending from the main body 18 of an adjacent tile 16. The lower tab 22 is restrained from vertical movement by the presence of the upper tab 20, as best shown in FIG. 4. FIGS. 3–6 depict hexagonally shaped tiles 16 having three sides with an upper tab 20 and three sides with a lower tab 22 in a regular arrangement. Other geometric arrangements may be used in the present invention. Hexagonal tiles are exemplary only. As shown in FIG. 4, there is an upper gap 24 between the main body 18 of each tile and an adjacent upper tab 20 and a lower gap 26 between the main body 18 of another tile 16 and the lower tab 22. These gaps 24 and 26 allow for expansion of the tiles 16 during operation of the electrolytic cell 2. Gaps 24 and 26 may be about 1/16 to about 3/16 inch wide.

The tiles are formed from a wettable ceramic material, such as $TiB_2$—C, and may include about 95 wt. % $TiB_2$ and about 5 wt. % C. The layer 14 of interlocking tiles 16 shown in FIG. 1 is depicted as being horizontal. Alternatively, the layer 14 may be up to about 5° from horizontal, such as about 0.5°. A slanted layer of interlocking tiles may assist in movement of molten aluminum into the chamber of a sump 28 shown in FIG. 1.

Figure 7:
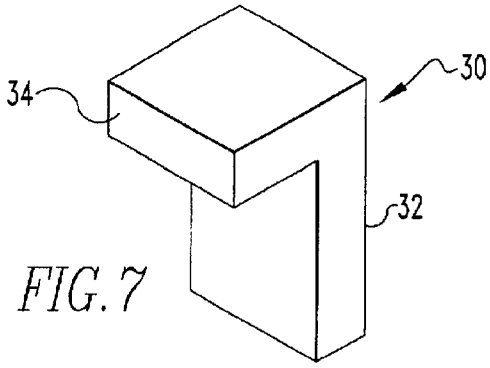
FIG. 7 is a perspective view of the retaining tile shown in FIG. 1.

In order to prevent movement of the interlocking tiles 16 towards the sump 28, particularly when the layer 4 is at an angle from horizontal, the cell 2 may include a plurality of retaining tiles 30 as shown in FIGS. 1 and 7. The retaining tiles 30 have an upper surface that is in the plane of the exposed surface of the layer 14 and are likewise produced from a wettable ceramic material. The retaining tiles 30 may be L-shaped with two legs 32 and 34. One leg 32 of the retaining tile 30 is fixed within the cathode block 10 or the sump 28. The other leg 34 of the retaining tile 30 is positioned on the edge of the sump 28 and has a surface even with the surface of the layer 14 of the interlocking tiles 16. Alternatively, a planar tile (i.e. not having leg 30) may be used in place of an L-shaped tile. Such a planar tile has one end having a surface even with the surface of the layer 14.

It has been found that a pilot scale 23 kA Hall-Heroult cell operated for a period of sixty days has a high current efficiency (93%) at a cell voltage of 4.1 to 4.3 with an anode to cathode distance of about 1 inch when using the tiles 16 of the present invention. The energy consumption has been shown to be reduced from the conventional consumption of comparable Hall-Heroult cell by about 10%, to 6.25 kWh/lb of aluminum. It is expected that similar energy savings are obtainable in a 70 kA cell.

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

We claim:

1. In an electrolytic cell for the production of aluminum at high temperatures comprising a cathode block positioned below an anode, the improvement comprising:

a plurality of interlocking wettable ceramic cathode tiles positioned on said cathode block, each said tile comprising a main body and a vertical restraining member which comprises an upper tab extending from one tile and a lower tab extending from another tile whereby said lower tab is restrained from vertical movement by said upper tab, wherein the upper surface of the tiles is positioned horizontally or up to about 5° from horizontal, and the main bodies are spaced apart by about 1/16 to about 3/16 inch.

2. The electrolytic cell of claim 1, wherein each said tile comprises an upper tab and a lower tab.

3. The electrolytic cell of claim 1, wherein each said tile is polygonal and comprises upper tabs extending from a plurality of sides of said tile and lower tabs extending from a plurality of other sides of said, where the cell can operate at from about 940° C. to about 980° C.

4. The electrolytic cell of claim 3, wherein said tiles are hexagonal.

5. The electrolytic cell of claim 1, wherein said tile comprises a $TiB_2$-C ceramic.

6. The electrolytic cell of claim 5, wherein said ceramic comprises about 95 wt. % $TiB_2$ and about 5 wt. % C.

7. The electrolytic cell of claim 1, wherein the cathode tiles allow said cathode block to be spaced at a reduced anode/cathode distance to about one inch from said anode.

8. An electrolytic cell for producing aluminum at high temperatures, said veil defining a chamber housing a cathode block positioned below an anode, said cell further comprising:

a plurality of interlocking wettable ceramic cathode tiles positioned on said cathode block, each said tile comprising a main body and a vertical restraining member which comprises an upper tab extending from one tile and a lower tab extending from another tile whereby said lower tab is restrained from vertical movement by said upper tab, wherein the upper surface of the tiles is positioned horizontally or up to about 5° from horizontal and the main bodies are spaced apart by about 1/16 to about 3/16 inch; and a sump defined in said cell for receiving molten aluminum.

9. The electrolytic cell of claim 8, further comprising retaining tiles for retaining said interlocking tiles apart from said sump.

10. The electrolytic cell of claim 9, wherein said retaining tiles comprise substantially planar members having one end in a plane with surfaces of said interlocking tiles and an opposing end fixed within said cathode block.

11. The electrolytic cell of claim 9, wherein said retaining tiles comprising L-shaped members having a pair of legs, one said leg being fixed within said cathode block and the other said leg extending towards said sump.

12. The electrolytic cell of claim 8, wherein each said tile is polygonal and comprises upper tabs extending from a plurality of sides of said tile and lower tabs extending from a plurality of other sides of said tile, where the cell can operate at from about 940° C. to about 980° C.

13. The electrolytic cell of claim 12, wherein said tiles are hexagonal and the cathode tiles allow said cathode block to be spaced at a reduced anode/cathode distance to about one inch from said anode.

* * * * *